US012129756B2

(12) United States Patent
Livescu et al.

(10) Patent No.: US 12,129,756 B2
(45) Date of Patent: Oct. 29, 2024

(54) CASING-EMBEDDED FIBER-OPTICS TELEMETRY FOR REAL-TIME WELL INTEGRITY MONITORING

(71) Applicant: Baker Hughes Holdings LLC, Houston, TX (US)

(72) Inventors: Silviu Livescu, Calgary (CA); Pierre-Francois Roux, Cypress, TX (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 589 days.

(21) Appl. No.: 17/351,580

(22) Filed: Jun. 18, 2021

(65) Prior Publication Data

US 2022/0403736 A1 Dec. 22, 2022

(51) Int. Cl.

| | |
|---|---|
| ***E21B 47/135*** | (2012.01) |
| ***E21B 17/02*** | (2006.01) |
| ***E21B 17/042*** | (2006.01) |
| ***E21B 47/007*** | (2012.01) |

(52) U.S. Cl.

CPC ..... *E21B 47/135* (2020.05); *E21B 17/023* (2013.01); *E21B 17/042* (2013.01); *E21B 47/007* (2020.05)

(58) Field of Classification Search

CPC ..... E21B 17/023; E21B 17/026; E21B 17/028

See application file for complete search history.

(56) References Cited

U.S. PATENT DOCUMENTS

| | | | | |
|---|---|---|---|---|
| 6,281,489 | B1 * | 8/2001 | Tubel | G01N 21/31 166/250.15 |
| 8,131,121 | B2 * | 3/2012 | Huffman | G01M 5/0041 356/73.1 |
| 9,044,798 | B2 * | 6/2015 | Peter | B21C 23/085 |
| 9,678,044 | B2 | 6/2017 | Wysocki et al. | |
| 2004/0112595 | A1 | 6/2004 | Bostick, III et al. | |
| 2007/0012872 | A1 | 1/2007 | Poland et al. | |
| 2011/0054808 | A1 * | 3/2011 | Pearce | G01B 21/32 702/42 |
| 2013/0094812 | A1 * | 4/2013 | Stoesz | E21B 47/135 385/76 |
| 2015/0176391 | A1 | 6/2015 | Albrecht et al. | |
| 2017/0227145 | A1 * | 8/2017 | Green | F16L 9/22 |

FOREIGN PATENT DOCUMENTS

| | | | | |
|---|---|---|---|---|
| EP | 2063068 | A1 | 5/2009 | |
| GB | 2430951 | A * | 4/2007 | E21B 17/025 |
| WO | 2016085480 | A1 | 6/2016 | |

OTHER PUBLICATIONS

Notification of Transmittal of the International Search Report and the Written Opinion of the International Searching Authority, or the Declaration; PCT/US2022/033731; Mail Date: Oct. 7, 2022; 12 pages.

(Continued)

*Primary Examiner* — Robert E Fuller

(74) *Attorney, Agent, or Firm* — CANTOR COLBURN LLP

(57) ABSTRACT

Optic fibers are embedded within the body of a casing section making up a wellbore casing string. The optic fibers are used to detect damage or deformation of the casing string over the lifespan of a wellbore.

3 Claims, 7 Drawing Sheets

(56) References Cited

OTHER PUBLICATIONS

Ning & Sava, Multicomponent distributed acoustic sensing: Concept and theory, Geophysics, vol. 83, No. 2, Mar.-Apr. 2018.
Earles et al., Real-Time Monitoring of Sand Control Completions, SPE 134555, 2010.
Pierce et al., Real-Time Compaction Monitoring with Fiber-Optic Distributed Strain Sensing (DSS), SPWLA 50th Annual Logging Symposium, Jun. 21-24, 2009.

* cited by examiner

CASING-EMBEDDED FIBER-OPTICS TELEMETRY FOR REAL-TIME WELL INTEGRITY MONITORING

BACKGROUND OF THE INVENTION

1. Field of the Invention

The invention relates generally to fiber optic monitoring systems for wellbore casing.

2. Description of the Related Art

Typically, when hydrocarbon production wells are drilled, metallic casing is installed to surround the borehole. The casing is secured in place with cement. Over long periods of time, damage can occur to the casing and the cement due to changes in its environment. For example, extraction of hydrocarbons can result in subterranean compaction which causes the density of the production formation to increase and allow layers within the formation to shift. This can result in significant deformation of the casing string. Casing strings can become bent, ovalized or compressed.

Loss of cement isolation in oil and gas wells causes undesirable fluid migration and is a common integrity problem that occurs both onshore and offshore. These well integrity events are difficult to detect with current technology in real time, or quickly enough after occurring, as it is expensive to locate the sources of annular leaks and to properly remediate the loss of cement isolation. Even for wells that initially display great isolation, routine events occurring throughout their life may cause a later loss of cement isolation, with the first signs being fluid appearance or excessive pressures where excessive pressures should not be located. Without monitoring, cement isolation may go undetected for a significant amount of time, and it can be difficult to acquire data and assess the exact cement isolation issue location for remediation.

Fiber optic monitoring has been used in various applications to monitor conditions within a wellbore once the wellbore has been completed. Distributed temperature sensing (DTS) fiber monitoring is one common example. Fiber optics have also been used to monitor strain and deformation for sand control completions (see SPE 134555, "Real-Time Monitoring of Sand Control Completions" by Earles et al. (2010)) by wrapping a "fiber express tube" around the equipment prior to running it into the wellbore. A similar wrap-on sleeve has been proposed for use with wellbore casing ("Real-Time Compaction Monitoring with Fiber-Optic Distributed Strain Sensing (DSS)" by Pearce et al. SPWLA 50$^{th}$ Annual Logging Symposium, Jun. 21-24, 2009).

SUMMARY OF THE INVENTION

The invention provides systems and methods for incorporating optic fiber arrangements into wellbore casing to permit monitoring of casing integrity during the life of the wellbore. One or more optic fibers are embedded within casing sections making up the wellbore casing string in order to provided telemetry to surface. Casing sections are described which include at least one optic fiber conduit formed within the body of the casing section into which optic fibers are disposed prior to cementing the casing in place. The optic fiber conduit can be one or more openings which pass through the body of the casing section. Alternatively, the optic fiber conduit can be one or more channels which are milled into the outer radial surface of the casing section. The inventors have found that the use of formed openings and/or channels to embed the fiber(s) within the casing section is advantageous as it prevents the fiber(s) from being damaged during cementing in of the casing.

In some described embodiments, optic fibers are oriented linearly in multiple openings which are placed in spaced relation around the circumference of casing. This allows different radial portions of the casing to be monitored for deformation or stress events. In some described embodiments, one or more optic fibers are placed in a spiral or helical manner within a channel formed in the outer radial surface of the casing member or members. In other described embodiments, a casing member incorporates both helical and linear fibers in order to provided for improved vector fidelity.

Methods are described for creating a fiber optic embedded casing string which can be monitored during its life span of use in a wellbore for deformation and damage. A casing string is formed by threadedly securing a first casing section having a first conduit with a second casing section having a second conduit. As the threaded connection is made up, the first and second conduits are aligned with one another so as to allow insertion of one or more optic fibers into the aligned first and second conduits. Additional casing sections may then be added to the casing string with the conduits of the additional casing sections aligned with the first and second conduits. The casing string is preferably then disposed within a wellbore and the optic fiber(s) disposed into the conduits of the casing string, thereby creating a fiber optic embedded casing string. This casing string can then be cemented into place within the wellbore.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
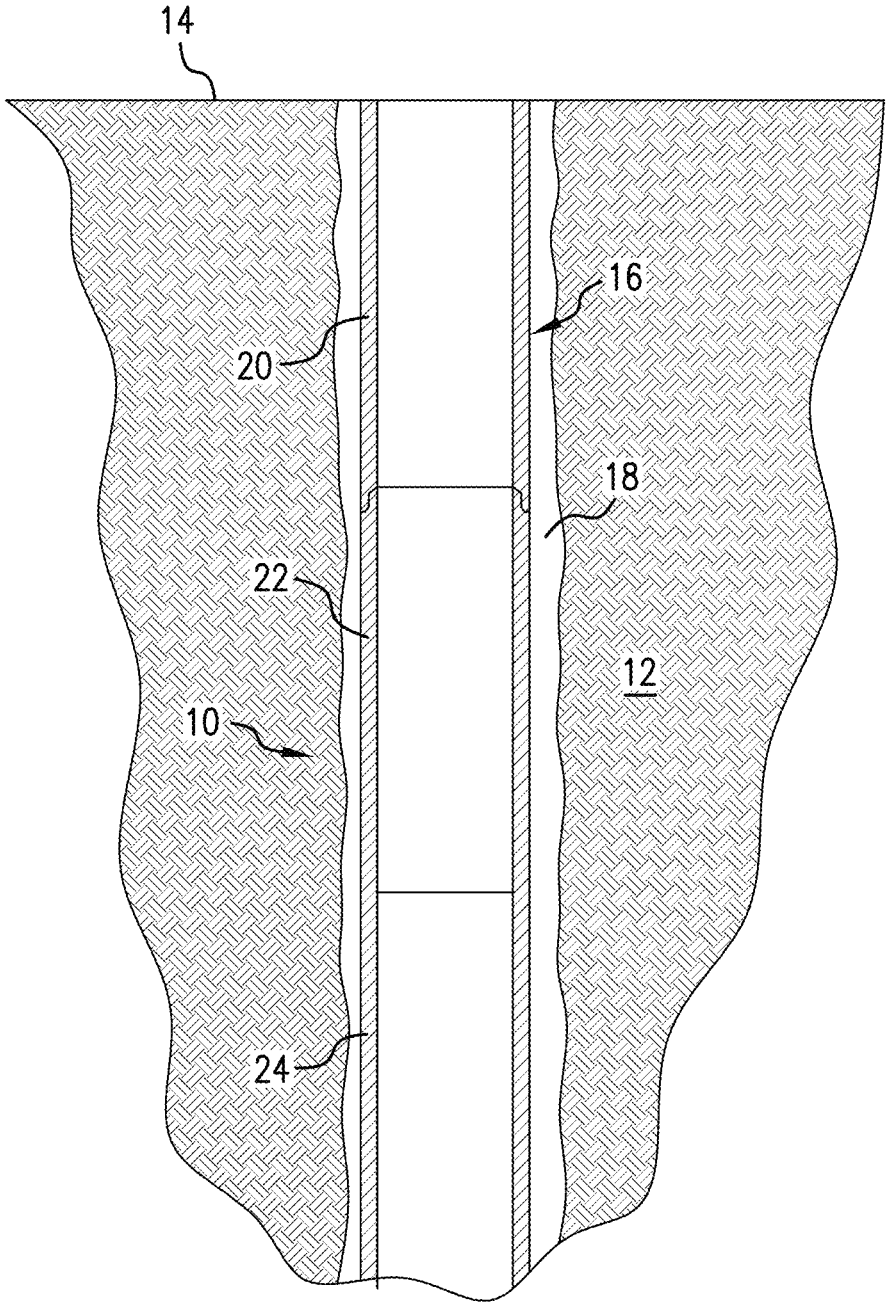
FIG. 1 is a side, cross-sectional view of an exemplary wellbore having casing constructed in accordance with the present invention.

FIG. 1 illustrates an exemplary wellbore 10 which has been drilled into the earth 12 from surface 14 downwardly toward a formation (not shown). A metallic production casing string 16 lines the wellbore 10 and is secured in place by cement 18. Casing is manufactured in casing sections 20, 22, 24 that are roughly 40 feet long and which are typically threaded together to create the casing string.

Figure 2:
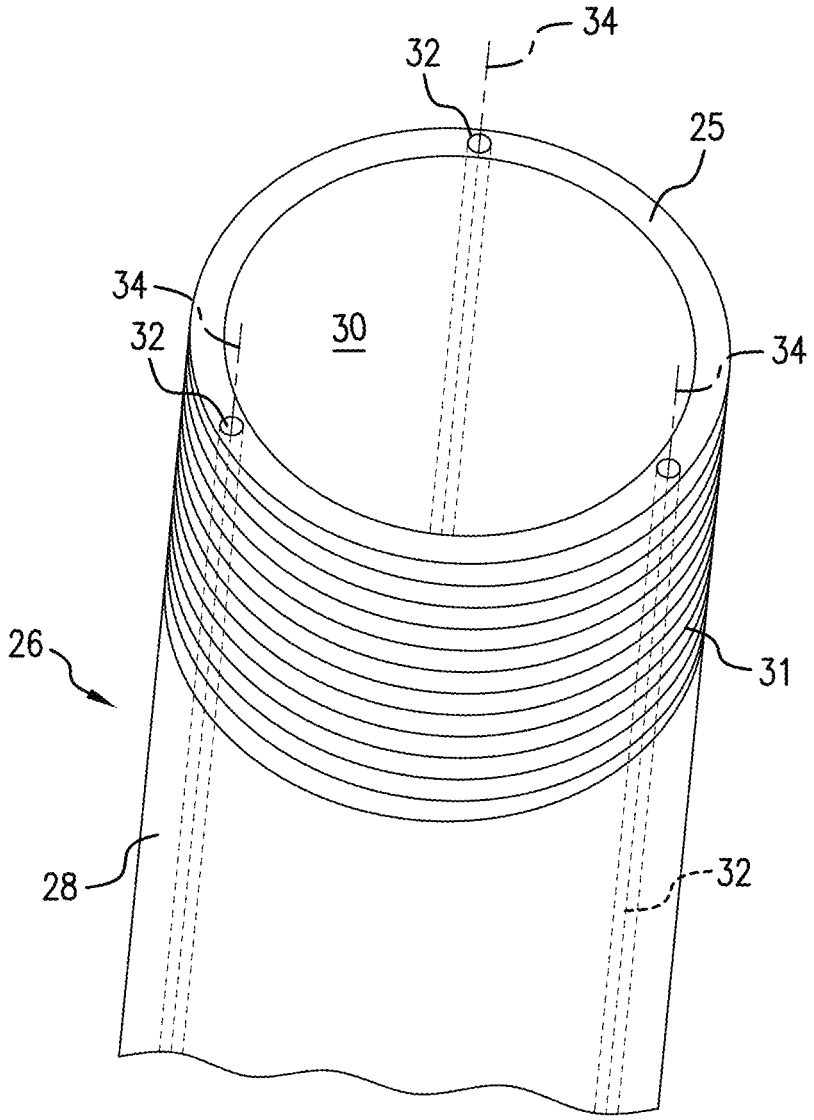
FIG. 2 is an isometric view of an exemplary casing section constructed in accordance with the present invention and having axial openings for retaining optic fibers.

FIG. 2 illustrates an axial end 25 for a first exemplary casing section 26 which may be representative of any of the casing sections 20, 22, 24 of the casing string 16 of FIG. 1. Casing section 26 includes a cylindrical casing section body 28 which defines the central flowbore 30 and which carries exterior threading 31. Several openings 32 are disposed axially through the body 28 in spaced relation about the circumference of the body 28. In the depicted embodiment, there are three axial openings 32. However, there may be fewer or more such openings as desired. Optic fibers 34 are disposed in each of the openings 32 and extend along the length of the casing section 26. The use of three fibers 34 allows for detection of deformation or stresses in three directions extending radially outwardly from the axis of the casing section 26. Four sets of openings 32 and fibers 34 would allow form detection in four radial directions. Preferably, the optic fibers 34 are manufactured to have a protective outer radial layer, such as an Inconel sheath, for protection of the fibers 34 and to avoid any potential failures due to poor insertion. The use of multiple fibers allows collection of distributed data from each fiber (i.e., temperature, acoustics and strain). Analytics and machine learning algorithms can then evaluate formation parameters in 3D (temperature, pressure, etc.).

Figure 3:
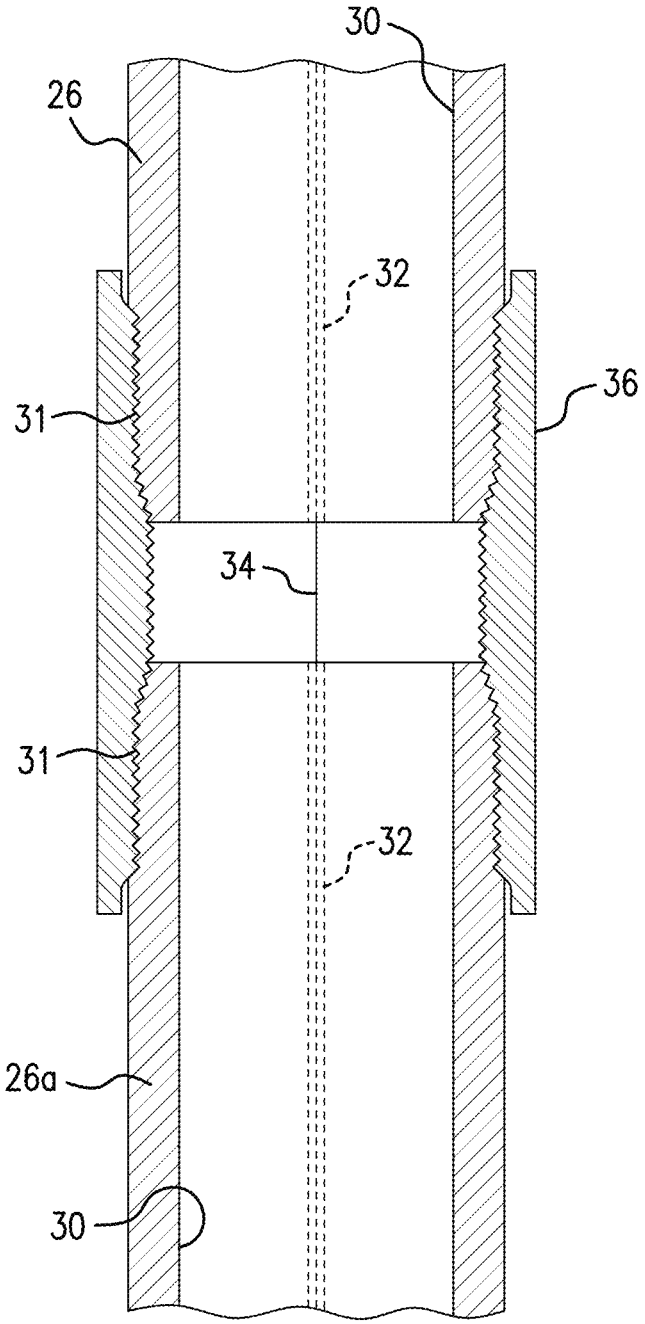
FIG. 3 illustrates connection of two casing sections having axial openings for optic fibers.

FIG. 3 illustrates the interconnection of two casing sections 26, 26*a* using a casing collar 36. It is noted that the openings 32 for the casing sections 26, 26*a* are aligned so that the fiber 34 may extend from one casing section to the next. Preferably, timed threads are used to ensure that the openings 32 are aligned as desired when assembled. It is preferred that each of the fibers 34 which pass through the casing sections 26, 26*a* and casing collar 36 are continuous with no splicing or mating connections. Fibers 34 are injected or otherwise disposed into the openings 32 once the casing sections are assembled together.

Figure 3A:
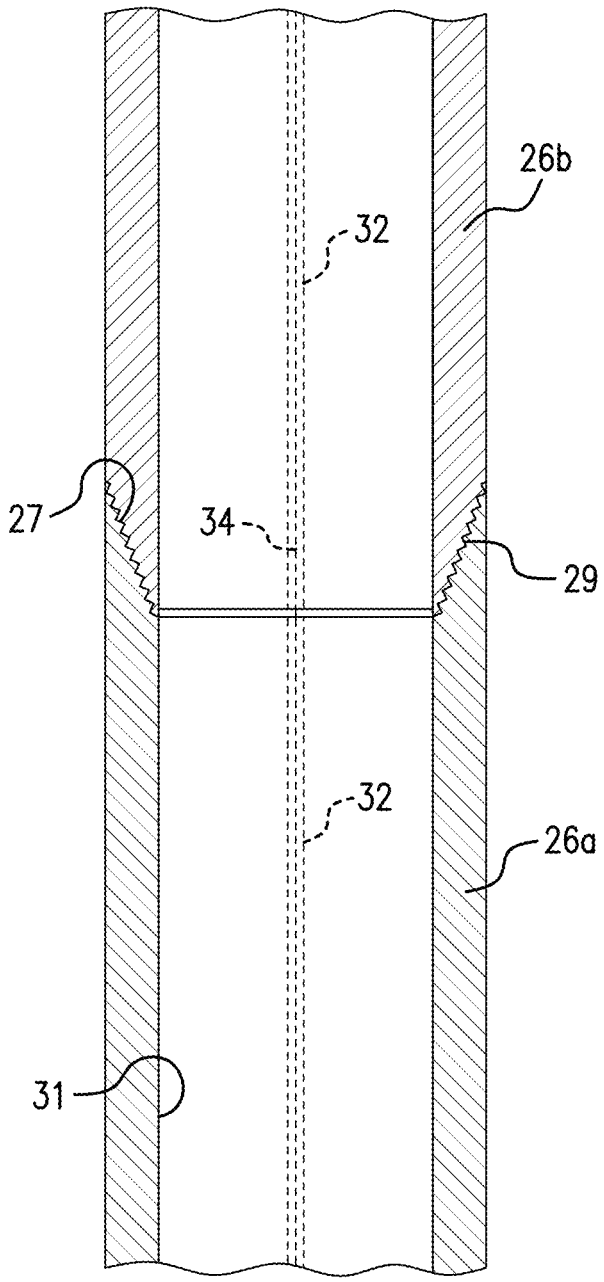
FIG. 3A is a side, cross-sectional view of an alternative exemplary connection of adjacent casing sections.

FIG. 3A illustrates an alternative interconnection of casing sections 26*b*, 26*c* which have been fabricated such that each of the casing sections is provided with a male threaded portion and a female threaded portion. In the connection shown, the female threaded portion 27 of the casing section 26*c* is directly threaded with the male threaded portion 29 of the casing section 26*b*. This alternative connection may be more protective of the fiber(s) 34 at the junction of the casing sections as less of the fiber(s) 34 are exposed to the central bore 31 of the casing string.

Figure 4:
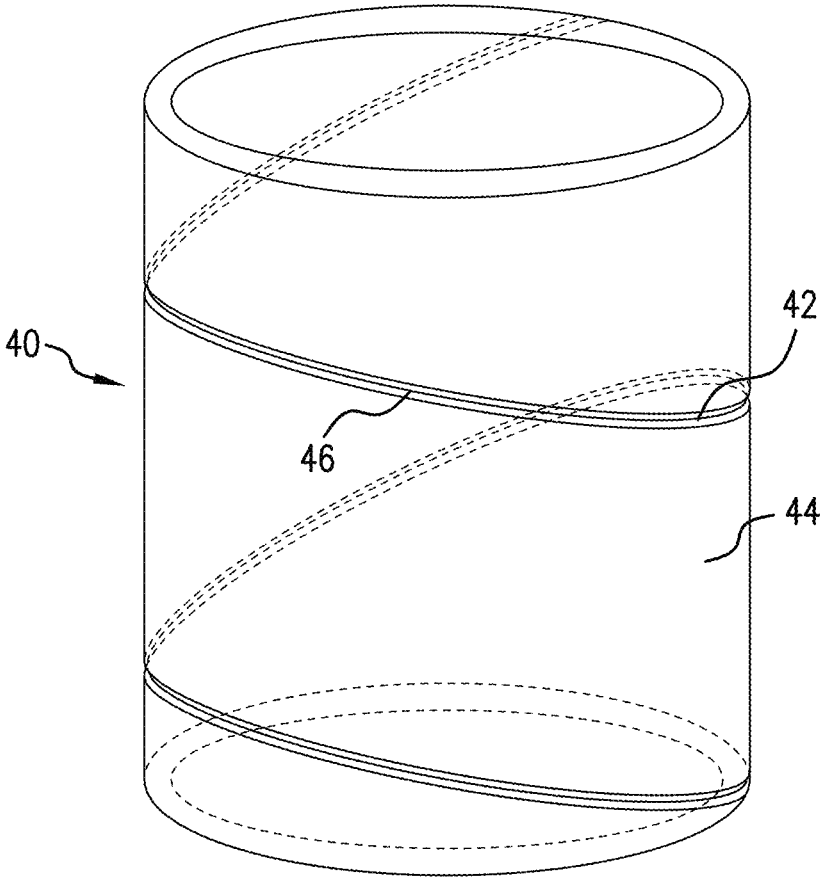
FIG. 4 is an isometric view of an alternative exemplary casing section in accordance with the present invention having helical channels for retaining optic fibers.
Figure 5:
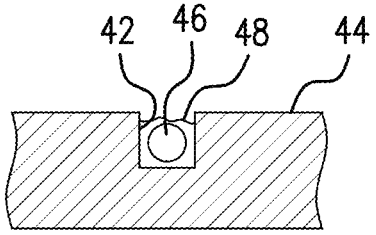
FIG. 5 is a detail view illustrating an optic fiber retained within an exemplary channel.

FIG. 4 depicts a portion of an alternative exemplary casing section 40 which may be representative of any of the casing sections 20, 22, 24 of the casing string 16 of FIG. 1. Casing section 40 is constructed in the same manner as casing section 26 described previously except that the openings 32 are not present. Instead, a helical channel 42 is inscribed into the outer radial surface 44 of the casing section 40. As best seen in FIG. 5, an optic fiber 46 is disposed in the channel 42. If desired, resin, epoxy or a similar material 48 may be used to help secure the fiber 46 within the channel 42. It is noted that, while the channel 42 has a helical formation on casing section 40, the channel might also be oriented in an axial linear configuration (i.e., the linear configuration of the openings 32, and there could be multiple such channels in order to accommodate a plurality of fibers.

Figure 6:
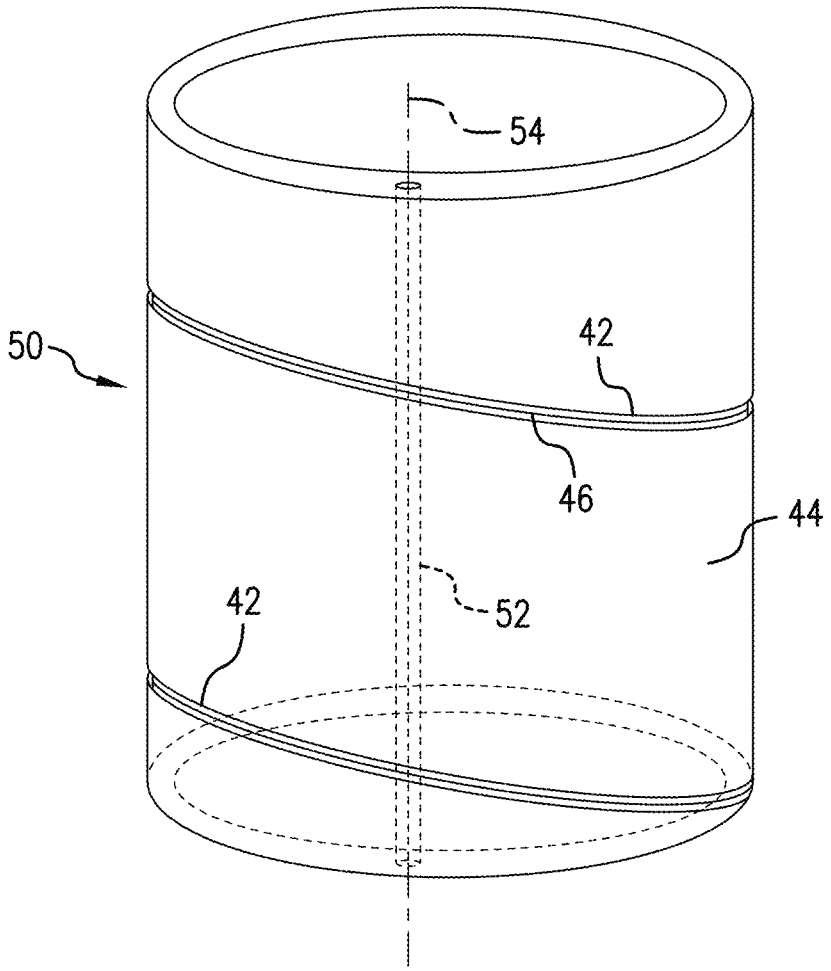
FIG. 6 is an isometric view of an exemplary casing section which incorporates both linear and helical optic fibers.

FIG. 6 illustrates a portion of a further exemplary casing section 50 which incorporates both a helical fiber and a linear fiber. The casing section 50 is constructed identically to the casing section 40 except for the addition of an axially oriented opening 52 which retains optic fiber 54. The use of a casing string design which incorporates both a helical fiber and a linear fiber permits multiple strain projections. Use of a helical fiber and a linear fiber allows improved resolution on any impinging (dynamic) wavefield by adding a "vector fidelity" which is absent when only a single helical fiber is used. See Ning, I., & Sava, P. (2018). Multicomponent distributed acoustic sensing: Concept and theory. *Geophysics,* 83(2), P1-P8. doi:10.1190/geo2017-0327.1.

Figure 7:
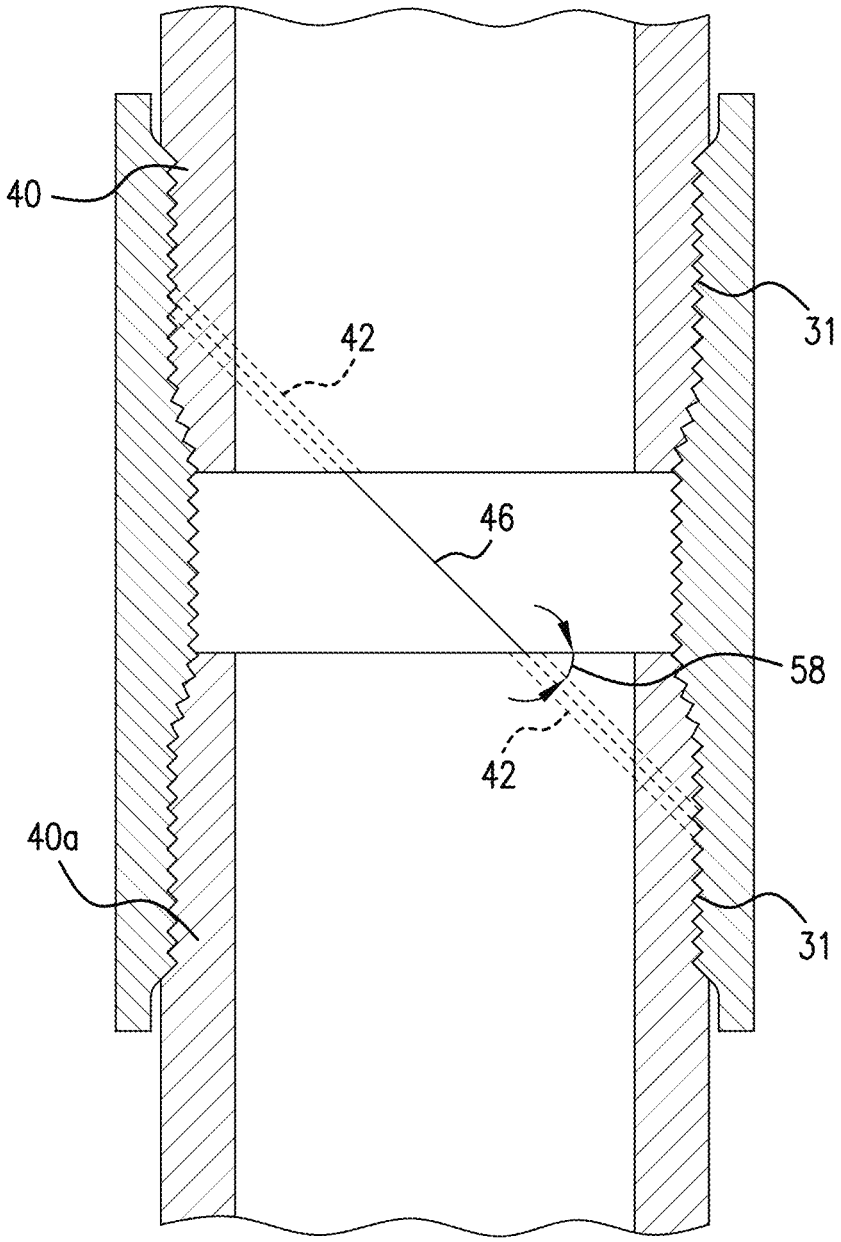
FIG. 7 is a side, cross-sectional view of a connection for two casing sections having helically oriented optic fibers.

FIG. 7 illustrates connection for two casing sections 40, 40*a* which each retain helical fiber 46. It is preferred that, when the connection is made up, as in FIG. 7, the channels 42 of each of the casing sections 40, 40*a* are largely aligned and match their pitch angle 56 so that the fiber 46 can transition from the channel 42 of one casing section 40 to the channel 42 of the other casing section 40*a* without having to significantly bend or kink the fiber 46.

Creating the openings 32 is preferably done by drilling done after the casing manufacturing process. The channels, such as channels 42, formed on the exterior of the casing section can be created by a milling motor or channel mill that would remove metal as a casing section is passed by it. Preferably, this is a well-controlled process which is consistent to remove the internal roughness of the groove to allow safe insertion of the fiber. The grooves are preferably manufactured before being shipped to location. The casing sections are then installed in a wellbore as needed and the optical fibers are inserted from the surface. Resin 48 can be pumped from the surface at a controlled rate (depending on its rheology, well length, formation pressure and temperature, and the groove cross-sectional area) either before or after cement 18 is pumped to secure the casing string 16 within the wellbore 10.

The systems and methods of the present invention allow the creation of a fiber optic embedded casing string which can be monitored throughout its lifespan of use for damage and deformation. Generally, a first casing section, which is provided with a first conduit, is threadedly connected with a second casing section which has a second conduit. The threaded connection may use a casing collar 36 or be a direct connection as depicted in FIG. 3A. The first conduit and second conduit are aligned with one another as the threaded connection is made up to create a casing string in order to assure that one or more optic fibers may be disposed into the aligned conduits. Additional casing sections having additional conduits may then be added to the casing string. Preferably, the casing string is disposed into the wellbore prior to disposing the optic fiber(s) into the conduits. Thereafter, the fiber optic embedded casing string is cemented into the wellbore using well-known techniques.

In use, the optic fibers 34 or 46 are operatively interconnected at surface 14 with an optical time domain reflectometer (OTDR) or similar equipment which will permit the fibers to be interrogated with backscattered light in order to measure mechanical strain which is experienced by the fibers. Because this general operation is understood by those of skill in the art, it is not described in detail here. The strain-sensing optic fibers 34, 36 are useful to detect the location of bending or axial compression forces which apply to a casing string over time.

What is claimed is:

1. A method of using a fiber optic embedded casing string in a well, comprising:

providing a first casing section having a first cylindrical body defining a central flowbore and a first axial opening disposed through an interior of the first cylindrical body and a first helical channel inscribed in an outer radial surface of the first cylindrical body;

providing a second casing section having a second cylindrical body defining the central flow bore and a second axial opening disposed through an interior of the second body and a second helical channel inscribed in an outer radial surface of the second cylindrical body;

threadedly connecting the first casing section and the second casing section to a collar to create a casing string, thereby aligning the first axial opening with the second axial opening and matching a first pitch angle of the first helical channel with a second pitch angle of the second helical channel;

disposing a first optic fiber through the first axial opening and the second axial opening and disposing a second optic fiber in the first helical channel and the second helical channel to create the fiber optic embedded casing string;

collecting data at the first optic fiber and the second optic fiber from the well; and evaluating a formation parameter based on the data.

2. The method of claim 1 further comprising:

disposing resin sealant within the first channel and the second channel.

3. A method of evaluating a wavefield impinging on a casing string, comprising:

disposing the casing string in a well, the casing string including:

a first casing section having a first cylindrical body defining a central flowbore and a first axial opening disposed through an interior of the first cylindrical body and a first helical channel inscribed in an outer radial surface of the first cylindrical body, a second casing section having a second cylindrical body defining the central flow bore and a second axial opening disposed through an interior of the second body and a second helical channel inscribed in an outer radial surface of the second cylindrical body, wherein the first casing section and the second casing section are threadedly connected to a collar such that the first axial opening is aligned with the second axial opening and a first pitch angle of the first helical channel matches the pitch angle of the second helical channel; and a first optic fiber disposed within the first axial opening and the second axial opening and a second optic fiber disposed within the first helical channel and the second helical channel;

receiving a wavefield impinging on the section at the first optic fiber and the second optic fiber; and evaluating a formation parameter from the wavefield.

* * * * *